US005806846A

United States Patent [19]

Lofink et al.

[11] Patent Number: 5,806,846

[45] Date of Patent: Sep. 15, 1998

[54] METHOD FOR PLAYING A MODIFIED BLACKJACK GAME

[76] Inventors: Kurt Lofink, 2324 Overthere La., Las Vegas, Nev. 89030; Richard Lofink, P.O. Box 33388, Las Vegas, Nev. 89133

[21] Appl. No.: 949,300

[22] Filed: Oct. 13, 1997

[51] Int. Cl.[6] ..... A63F 1/00

[52] U.S. Cl. ..... 273/292

[58] Field of Search ..... 273/292, 303, 273/305

[56] References Cited

U.S. PATENT DOCUMENTS

| | | | |
|---|---|---|---|
| 5,636,843 | 6/1997 | Roberts | 273/292 |
| 5,660,391 | 8/1997 | Klasee | 273/292 |
| 5,702,106 | 12/1997 | Alvarez, Jr. | 273/292 |
| 5,713,573 | 2/1998 | Nazaryan | 273/292 |
| 5,732,949 | 3/1998 | Josephs | 273/292 |
| 5,743,532 | 4/1998 | Lafferty | 273/292 |

*Primary Examiner*—William E. Stoll
*Attorney, Agent, or Firm*—Quirk & Tratos

[57] ABSTRACT

A method for playing a modified game is provided wherein, if the dealer shows an Ace as the up card, and after action is completed regarding insurance wagers, the dealer exposes the down card regardless of whether or not the dealer has a Blackjack. In a further or additional embodiment, if the player has a predetermined holding from the initial cards dealt such as a twelve and draws a ten value card to bust, at least a portion of the player's wager is returned to the player. As but yet a further feature, the player may opt to make a bonus wager. If the player makes a bonus wager and from his initial two cards has a card which matches in denomination or both denomination and suit, the player is rewarded up to 10:1 on the bonus wager whether or not the player ultimately wins his Blackjack wager. Additionally the bonus wager may be applied in the event the dealer's up card is a two and the player has a specified initial holding. Large payoffs may be provided for certain specified holdings.

4 Claims, No Drawings

METHOD FOR PLAYING A MODIFIED BLACKJACK GAME

FIELD OF THE INVENTION

This invention relates to a card game, and more particularly to a card game which provides certain modifications to the game of Blackjack also known as Twenty-One.

BACKGROUND OF THE INVENTION

Conventional Blackjack, as is well known, involves a game of chance between a dealer and one or more players using one or more standard decks having fifty-two playing cards. The object is for the player to achieve a count of his hand closer to and/or a count of 21 than the count of the hand of the dealer; but if the count of the player's hand goes over 21 then the player loses regardless of the final count of the dealer's hand.

The manner of play according to the standard and well known rules therefor is as follows: A standard deck of fifty-two playing cards is used and each card counts its face value, except Aces which have a value of one or eleven as is most beneficial to the count of the hand and face cards, i.e. Kings, Queens and Jacks, have a count of ten. After making a wager, each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards (take "hits") in order to try and beat the count of the dealer's hand. If the player's count exceeds 21, the player "busts". The player may "stand" on any count of 21 or less. When a player busts, he loses his wager regardless of whether or not the dealer busts.

After all of the players have taken hits or have stood on their hand or have busted, the dealer "stands" or "hits" based on pre-established rules for the game. Typically, if the dealer has less than 17, the dealer must take a hit. If the dealer has 17 or more, the dealer stands.

As the game of Blackjack is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of 11, instead of as a count of 1. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts (his numerical hand count exceeds 21), the player wins regardless of the numerical count of the player's hand. If neither the player nor the dealer has busted, the closest hand to a numerical count of 21, without going over, wins; tie hands are a "push".

Another rule of conventional Blackjack is that if the dealer has an exposed (or up card) Ace, the player is given an opportunity to make an insurance wager of up to one half of his original bet that the dealer will have a Blackjack (an Ace and a ten value card). If the player has made the insurance wager and indeed the dealer has a Blackjack, the player loses their original bet but is paid 2:1 on the insurance wager effectively winning back their lost bet. If the dealer does not have a Blackjack several significant events occur. First, the player's insurance wager is lost. Second, the player knows that despite the dealer having an exposed Ace, he does not have 21. Thus the dealer could hold any hard or soft total from 2 to 20. Since the dealers down or "hole" card remains unexposed, the player is not provided with any more information to guide the decision to hit or stand.

Further standard or conventional Blackjack has rules regarding payoffs for winning hands. Blackjack winning hands are paid at 3:2. All other winning hands are paid at even money. Again, if the player and dealer both have Blackjack, the hand is a push. Further if the player has a non-Blackjack 21 and the dealer has a Blackjack, the player loses. These payoffs along with the insurance payoff are the only payoffs in conventional Blackjack.

As can be appreciated, standard Blackjack does not offer the opportunity to win greater than 3:2 which occurs when the Player receives a Blackjack which only occurs about 1 out of 22 hands. Therefore, the player sees an even money payout for winning hands about 95% of the time. Additionally, the player's fortunes rise or fall based upon the player's ability to obtain a closer holding to 21 than the dealer. If the dealer is particularly "hot" or the player is "cold" the player may not have the opportunity to beat the dealer and become frustrated with the game. This is particularly true when the player receives first two card totals of 12 through 16 and thereafter draws 10 value cards to bust on a routine basis. There is a need for a modified method of play of conventional Blackjack which provides the player with additional opportunities to win greater payoffs, which enables the player to, in some circumstances, have the dealer expose his down card prior to the player deciding to draw and which reduces the penalty on players who at least perceive that they are receiving poor hands on a consistent basis.

SUMMARY OF THE INVENTION

There is, therefore, set forth according to the present invention a modified method for playing a Blackjack game which requires the dealer, in certain circumstances, to reveal their down card, which reduces or eliminates the penalty a player receives who had a poor initial holding and who subsequently busts and which provides, subject to the placement of a bonus wager, the opportunity for a player to reap greater rewards regardless of whether or not they ultimately win their initial or base wager.

According to one embodiment of the present invention a method for playing a modified game of Blackjack is set forth which includes one or both of the following improvements:

(a) providing at least one deck of playing cards;

(b) the Player making a wager:

(c) dealing two cards to the Player and the Dealer, one of the Dealer's cards dealt face down;

(d) if the Dealer has an exposed Ace, after the Player has opted to take or not take insurance according to the rules of Blackjack, exposing the Dealer's face down card, (1) if the Dealer has a Blackjack, resolving the Player's hand versus the Dealer's hand according to the rules of Blackjack, (e) if the Player's first two cards total twelve through sixteen according to the rules of Blackjack and (1) the Player draws a third ten value card giving the Player a total exceeding twenty-one, returning at least a portion of the Player's wager to the Player, and (f) if rules (d) or (e) do not apply, the Player and Dealer drawing additional cards according to the rules of Blackjack to complete their hands; and (g) resolving the Player's completed hand versus the dealer's completed hand according to the rules of Blackjack.

Preferably, rule modification (e) (1) returns a portion of the player's wager if they had an initial two card holding of twelve and draw a third card having a ten value, e.g. a 10, Jack, Queen or King. The twelve constitutes the holding for this rule to apply and may require that the twelve be comprised of a two and a ten value card. Further, in the event the rule is applied, at least ten percent of the player's wager is returned with the house or casino collecting the rest.

In another aspect of the present invention a method is set forth for playing a modified game of Blackjack which includes:

(a) providing at least two decks of playing cards;

(b) the Player making a base wager and a bonus wager;

(c) dealing an initial hand of two cards to each of the Dealer and Player, exposing one card of the Dealer's initial hand;

(d) providing at least one of the following rules, (1) if any card of the Player's initial hand matches in at least denomination the Dealer's exposed card, paying the Player based upon the bonus wager, otherwise collecting the bonus wager, (2) if the Dealer's exposed card is a two and the Player has a predetermined initial hand paying the Player based upon the bonus wager, otherwise collecting the bonus wager, (e) the Dealer and Player completing the play of their hands according to the rules of Blackjack.

Preferably, for denomination matching the player is paid at least 3:1. If any card of the player's initial holding matches in suit and denomination, the player is paid an even greater reward. Also preferably, where the dealer has an up card of a two the player is paid on the bonus wager for any holding and greater amounts for pairs, same suit (suited) pairs, pairs of 2's and suited 2's. As can be appreciated, the player is paid for matching and where the dealer has a 2 up card regardless of whether or not they win the hand.

The aforesaid modifications to the method for playing Blackjack increases the excitement by providing greater information to the player when the dealer has an Ace up card, returns at least a portion of the player's wager when, in certain circumstances, the player busts and provides a bonus wager paid when any card in the player's initial holding matches the dealer up card. Further, player's making the bonus wager are rewarded when the dealer shows a 2 up card.

DETAILED DESCRIPTION OF THE PREFERRED EMBODIMENTS

In the preferred embodiment of one aspect of the present invention, at least one deck of cards is provided. Preferably the deck is a standard deck of fifty-two cards but it should be understood that the deck could be modified by removing certain denominations of cards as described in U.S. Pat. No. 5,615,888 issued Apr. 1, 1997 and entitled Spanish twenty-one card game method of play, the disclosure of which is hereby incorporated by reference.

In a known manner applicable to the conventional game of Blackjack, prior to the dealing of a hand the player makes a selected base wager, the amount of which may be dictated by predetermined table minimum and maximum wagers. While the description as hereinafter set forth is simplified to describe the play of one player against the dealer it is to be understood that numerous players can compete against the dealer as is well known in the game of Blackjack.

After the player has made their base wager, the dealer, from the shuffled deck or decks of cards, deals two cards to the player and to himself/herself. The second card dealt to the dealer is dealt face up and is exposed for the player to see. This, too, is in the manner consistent with the conventional game of Blackjack.

At this point of play, if the dealer's up card is an Ace, the dealer will inquire regarding, and the player will be given the opportunity to make, the insurance wager. If the player decides to take insurance he/she posts the insurance wager of up to one-half of their original wager in a designated location on the playing table. After the player has been given the opportunity to take insurance, the dealer checks the down or "hole" card to determine if it is a ten value (i.e. a 10, Jack, Queen or King) in which case the dealer has a Blackjack. If the dealer has a Blackjack, the down card is turned over and the player's hand is resolved in the manner consistent with the known rules of Blackjack. If the dealer has a Blackjack and player has taken insurance, the insurance wager is paid at 2:1 whereby the player preserves their initial wager. If the dealer does not have a Blackjack, and according to the modified version of the game according to the present invention, the dealer exposes their down card nonetheless for the players to see. Unlike conventional Blackjack, where if the dealer does not have a Blackjack the down card remains hidden from view, according to this embodiment where the dealer has an exposed Ace the down card is always exposed regardless of whether or not the dealer has a Blackjack. By exposing the down card the player knows the dealer's two card total and can use this information to decide whether to stand, double down, split or take another card according to the rules of Blackjack. For example, if the player has a soft 19 (Ace and an 8) and the dealer has an up card Ace and exposes a down card 7, the player knows to stand since he has already beaten the dealer. On the other hand if the dealer exposes a 9 to give the dealer a total of 20, the player knows to take a hit.

By exposing the dealer's down card in the circumstances when the dealer has an up card Ace, the excitement of the game is enhanced in that, in these circumstances, the player knows what the dealer's initial holding is and the likely action of the dealer. This gives the player an advantage in these circumstances and would, it is believed, increase the play of the game.

According to another embodiment of the modified Blackjack game of the present invention, where the player's initial holding of two cards is a 12, 13, 14, 15 or 16 and the player is entitled to draw a third card, i.e. where the dealer does not have a Blackjack precluding further play by the player, and the player draws a ten value card (10, Jack, Queen, King) to have a total greater than 21, at least a portion of the player's wager is returned to the player. Under the conventional rules, where a player exceeds a total count in their hand of 21, the player "busts" and loses the entirety of their wager. According to the method for playing a modified game of Blackjack of the present invention, where the player has a predetermined count of their initial cards and draws a ten value card to bust, at least a portion of their wager is returned.

In the preferred embodiment of this version of the present invention, the predetermined initial count of the player's first two cards for invocation of the rule is 12, e.g. an 8 and a 4. Additionally the rule may require that the 12 consist of a ten value card and a 2, e.g. a Queen and a 2, to decrease the frequency that the rule is applied.

As stated above when the rule is invoked and the player draws a third card ten value card, at least a portion of the player's wager is returned to the player. This returned portion may be all of the player's wager in essence calling the hand a push. Alternatively, only half or some other portion is returned depending upon the vigorish desired by the casino. Preferably at least ten percent of the player's wager is returned to the player when the rule is applied with the remainder collected by the casino.

According to the method of this embodiment, a normally losing hand results in no or at least a smaller loss to the player. Where the player has a poor initial predetermined holding of preferably a 12 and draws a ten value card, all or at least a portion of the player's wager is returned to the player. Under conventional rules, all of the player's wager would be lost. This rule will encourage play of the game by giving the player a favorable or less onerous outcome when the player is disheartened by a poor initial holding. Further the rule will encourage players to hit the predetermined holding increasing the excitement of the game. A player may not normally hit a 12, but this rule will encourage drawing a third card which may result in the player drawing a 9 to obtain a 21. This event increases the excitement at the Blackjack table.

It is to be understood that the method according to the present invention may incorporate both of the above identified modifications of the Ace up exposure of the dealer's down card and the feature of returning at least a portion of the player's wager when they have a predetermined initial holding and draw a third, ten value card.

A further aspect of the method of the present invention will now be described. According to this embodiment at least two decks of cards are used to play the game. The cards, for two decks, may be dealt by hand. For three or more decks the cards may be dealt from a shoe.

According to this embodiment of the method, the player makes the conventional Blackjack base wager in the manner described above and opts to make a bonus wager. The bonus wager is not required. The following description will presume that the player has made a bonus wager.

After the base and bonus wagers have been made, the dealer deals two cards to the player and to himself/herself. The dealer, as is conventional in Blackjack, exposes the second or up card. At this point, the method of the present invention provides that the player examines their two initial cards and if either of the cards match the dealer's up card they are rewarded based upon their bonus wager. For example, if the dealer has an up card of a four of spades and the player holds a four of hearts and a Queen of spades, the player wins the bonus wager. If either of the player's initial two cards match in denomination and suit the player is paid a greater amount. For the example given above, if the player also held a four of spades he would match in suit and denomination. Preferably the payoffs for the bonus wager based upon the number of decks used and whether the player matches in denomination or both suit and denomination is as set forth in Table 1 below.

TABLE 1

| No. of Decks | Denomination Match | Suit and Denomination Match |
|---|---|---|
| 2 | 4 to 1 | 10 to 1 |
| 6 | 3 to 1 | 10 to 1 |

For the number of decks and payoffs set forth in Table 1 it has been determined that the casino has an acceptable vigorish on the bonus wager for both two deck and six deck games. It has also been determined that for a table occupied by seven players it would be expected that at least one of the players will have a denomination or suit and denomination match for each round or hand of play.

If a player did not make the bonus wager, there is no action if the player has a match.

As can be appreciated, the bonus wager for the match increases the revenues for the casino by virtue of the profit or vigorish provided by this extra wager with no additional strategy required by the player. Further, the method incorporating this modification increases the excitement of the game. Players obtaining the match will receive a reward many times their bonus wager without respect to whether or not they win their base wager. That is the player may win the bonus wager and ultimately lose their base wager by busting or being bested by the dealer.

According to another aspect of the present invention the method includes another opportunity for the player to win. Like the method described above, the player makes a bonus wager along with their base wager. The dealer deals an initial holding to the player and to himself, the dealer turning over his second card as the up or exposed card. If the dealer's up card is a 2 the player has the opportunity to win based on the bonus wager. While one or more initial player holdings may be selected to trigger a bonus payoff, preferably the player is paid for the initial holdings and payoff schedule set forth in Table 2 below.

TABLE 2

| Dealer's Up Card | Player Holding | Payoff |
|---|---|---|
| 2 | Any Holding | 5:1 |
| 2 | Any Mixed Pair | 10:1 |
| 2 | Any Suited Pair | 50:1 |
| 2 | Pair of 2s | 100:1 |
| 2 | Suited Pair of 2s | 500:1 |

By suited pairs what is meant is that the cards are of the same suit and same denomination, e.g. two 4s of spades. Since more than one deck is used, suited pairs can occur.

It is to be understood that the payoff schedule could be modified to offer different payoffs and additional initial holdings could be designated for payoffs.

This feature, which may be combined with the method for offering a bonus payoff if the player matches the dealer's up card, enhances the excitement of the game. Further these bonus payoffs occur whether or not the player wins the base wager, Blackjack hand.

As stated above the aforementioned modifications can be combined in any fashion to enhance the game of Blackjack and can be used with modified decks or standard decks.

While we have shown and described certain embodiments of the present invention it is to be understood that it is subject to many modifications without departing from the spirit and scope of the appended claims.

We claim:

1. A method for playing a modified game of Blackjack between a Player and a Dealer comprising:

(a) providing at least two decks of playing cards;

(b) the Player making a base wager and a bonus wager;

(c) dealing an initial hand of two cards to each of the Dealer and Player, exposing one card of the Dealer's initial hand;

(d) if any card of the Player's initial hand matches in at least denomination the Dealer's exposed card, paying the Player based upon the bonus wager, otherwise collecting the bonus wager; and (e) the Dealer and Player completing the play of their hands according to the rules of Blackjack.

2. The method of claim 1 including paying the player a first reward if any card of their initial hand matches the Dealer's exposed card denomination and a second reward where the card matches in both denomination and suit.

3. The method of claim 2 including paying the Player at least 3 to 1 on the bonus wager where the match is denomination only and at least 10 to 1 where the match is in denomination and suit.

4. The method of claim 3 including paying the Player based upon the bonus wager and the number of decks used to deal the cards according to Table 1

TABLE 1

| No. of Decks | Denomination Match | Suit and Denomination Match |
|---|---|---|
| 2 | 4 to 1 | 10 to 1 |
| 6 | 3 to 1 | 10 to 1 |

* * * * *